United States Patent [19]

Wasserman

[11] Patent Number: 4,697,362

[45] Date of Patent: Oct. 6, 1987

[54] REMOVABLE INDICIA FOR FOOTWEAR, PARTICULARLY AND ATHLETIC SHOE

[75] Inventor: Albert Wasserman, St. Louis, Mo.

[73] Assignee: Kangaroos U.S.A., Inc., St. Louis, Mo.

[21] Appl. No.: 814,763

[22] Filed: Dec. 30, 1985

[51] Int. Cl.[4] ..... A43B 23/24

[52] U.S. Cl. ..... 36/136; 428/67; 428/100; 428/13; 2/DIG. 6; 40/2 E

[58] Field of Search ..... 428/100, 67, 13; 36/136; 2/DIG. 6; 40/2 E; 283/81, 98

[56] References Cited

U.S. PATENT DOCUMENTS 3,484,974 12/1969 Culmone ..... 2/DIG. 6

4,513,454 4/1985 Anderson et al. ..... 2/DIG. 6

FOREIGN PATENT DOCUMENTS 1497611 10/1967 France ..... 2/DIG. 6

*Primary Examiner*—Alexander S. Thomas

*Attorney, Agent, or Firm*—Paul M. Denk

[57] ABSTRACT

This invention relates to the structure of footwear, and more specifically athletic shoes, but encompasses shoes in general, and pertains to the application of a tab containing identifying indicia or colors removably to various components of the shoe, whether it be the tongue, quarter portion, or side of the shoe sole, and will preferably be structured as a form of support for such indicia and which is recessed within the sides of the shoe sole; and regardless where the support is applied, it may be preferably held in position through the application of hook and pile type of fastener means so that it is readily removable and can be replaced with a support containing indicia of other terms, styles, designs, colors, and patterns.

3 Claims, 4 Drawing Figures

REMOVABLE INDICIA FOR FOOTWEAR, PARTICULARLY AND ATHLETIC SHOE

BACKGROUND OF THE INVENTION

This invention relates generally to the application of removable indicia to footwear, and particularly footwear in the category of an athletic shoe, casual shoe, and the like.

As is well known this day and age, the sustaining sale of products generally in the category of fashion oriented clothing, footwear, and the like, depends substantially upon not only the particular style designed into the item of clothing, but likewise, the identifying means in the nature of the trademark, the service mark, tradename, of the like, or generally, the designer's lable, used for distinguishing the source or origin of the manufactured and marketed product. As a result, and as has become quite apparent over the past few decades, the application of an identifying source, as in the nature of a trademark, or the like, to items of clothing have become quite a prominent business practice, and well accepted to the marketing trade. But, the usual procedure thus far employed in the application of such indicia to clothing has been either through the application of stitching, an adhesive, or through the silk screening or otherwise printing of the trademark directly to the manufactured goods. Hence, the removal, replacement, or transfer of such indicia upon clothing through the concept of this current invention, and that is by applying a removable means to the footwear so that the trademark can be removed, or replaced with another, to applicant's knowledge, has never been employed.

It is, therefore, the subject matter of this current invention to provide means for removably applying an identifying indicia, design, slogan, or other print to items of clothing, but particularly footwear, and which can be removed and replaced with related means.

Another object of this invention is to provide the application of a label, or the like, through the agency of Velcro, or that hook and pile type of fastener, to designated components of footwear, so that the trademark or other indicia applied to the label may be either removed or replaced, as a change of display.

Another object of the invention is to provide the application of identifying indicia, or design, to a support means that is applied to the sole of an athletic or other type of shoe, and which may extend for a short distance, or even a substantial distance, around the heighth of the sole in order to add to the attractiveness, but yet versatility of appearance, for the footwear to which the concept is applied.

Another object of this invention is to provide the application of the foregoing type of indicia to the sole of an athletic shoe, and which may be recessed therein so as to afford uniformity of appearance in the flush mount of the display within the sole of any type of shoe to which it is applied.

Another object of this invention is to provide a removable tab that may be applied to various components of footwear, and particularly an athletic shoe.

These and other objects will become more apparent to those skilled in the art upon reviewing the summary of this invention, and upon undertaking a study of the description of its preferred embodiment, in view of the drawing.

Prior art known to applicant relating to the subject matter of this invention include decorative means that may be applied and replaced along the sides or quarter portion of footwear, such as through the insertion of color patches within a rimmed pocket part, as disclosed in the U.S. Pat. No. 2,801,477, to Adams, et al. In addition, applicant is aware that similar type of color patches are applied to shoes, as a means of attaching identification or color changes also to the sides or quarter portions of footwear. The use of Velcro for applying a pocket onto clothing is generally disclosed in the prior U.S. Pat. No. 3,537,108, to Daniels. In addition, the use of Velcro for holding straps, or the like, onto footwear is shown in the prior U.S. Pat. No. 4,065,861, to Pelfrey, in addition to the various Antonious U.S. Pat. Nos. 4,282,657, 4,451,995, 4,126,951, and 4,296,558. Furthermore, the patent to Giese, No. 4,366,634, discloses a related embodiment. Also, the prior U.S. Pat. No. 4,280,287, ent to Gulbransen, shows the use of Velcro for holding a pocket to a shoe. In addition, the use of Velcro for holding pocket flaps onto a shoe or footwear are shown also in the prior U.S. patent to Robert J. Gamm, in U.S. Pat. Nos. 4,296,559, and 4,384,418. These two latter patents are owned by a common assignee of the invention of this current application. These are examples of known prior art.

SUMMARY OF THE INVENTION

This invention contemplates the application of a label or other information containing tab to clothing, and particularly footwear. The tab may be formed in the configuration of a label, having a fastening means applied to its back surface, preferably formed of Velcro, and which can be applied at various locations around the select components of the footwear, particularly of its tongue, quarter portions, and even the periphery of the shoe sole, as along its side. As explained herein, the side of the shoe sole may comprise that lateral portion adjacent to the quarter parts of the footwear, but more preferably, the shoe side will comprise that heighth of the shoe sole entirely arounds its perimeter, regardless whether it be at a lateral position, around the heel, or even adjacent the footwear toe.

In any event, the label means preferably will be formed as a support means for holding the various identifying indicia, whether it be of a fanciful design, a trademark, tradename, service mark, or other indicia, and will have sufficient flexibilities so as to provide for its snug adherence onto some aspect of the footwear, as previously explained. Furthermore, the support means, as explained, will have sufficient surface area, with the identifying indicia applied to its exposed surface, and having the fastener means in the form of Velcro, which is a hook and pile type of fastener, applied to the backside of the support, and joined with corresponding Velcro that is applied to some component of the shoe, or along the sides of its sole, as previously explained. The support means may be formed in the shape of a plug, such as formed of a polymer, rubber, or the like, and may even have the identifying indicia, or the trademark, molded upon its exposed and frontal surface. The plug may be designed having a shallow depth, and be readily adaptable for insertion into a recess formed along the side of the shoe sole, so that once applied, its surface may be flush mounted with the shoe midsole, or around its sole, and generally present a uniform appearance in the display as disposed for affording what may appear to be an integrally constructed design that is inherent in the molding of the shoe sole construction. In addition, the plug displaying the indicia may be of a short length for showing just a single trademark, or other design, or it may extend for some distance, as around the shoe sole side, which may embody not only a lateral portion of the shoe sole, but around its heel, toe, or the like. In this manner, a repeat display of the design or identifying indicia, such as a trademark, may be presented in the shoe sole structure, and be removable therefrom, and replaced with other forms of design that may be applied thereto, at the whim and wish of the shoe wearer.

Obviously, the footwear to which this identifying indicia, as fabricated under the teachings of this invention, may be applied include any form of footwear, such as a casual shoe, a walking shoe, or any other form of the athletic shoe. In addition, the plug means displaying the indicia may simply comprise a surface of one or a variety of colors, so that the shoe sole may have interchanged upon it various color patterns, depending on the desire of the wearer. Thus, the fashion for the shoe may be changed, color and designwise, to an infinite variety depending upon what is available to the wearer of the footwear, and his/her desire for various designs.

BRIEF DESCRIPTION OF THE DRAWING

In referring to the drawing, FIG. 1 provides an isometric view of an item of footwear, such as an athletic shoe, disclosing the application of the subject matter of this invention at two locations.

DESCRIPTION OF THE PREFERRED EMBODIMENT

Figure 1:
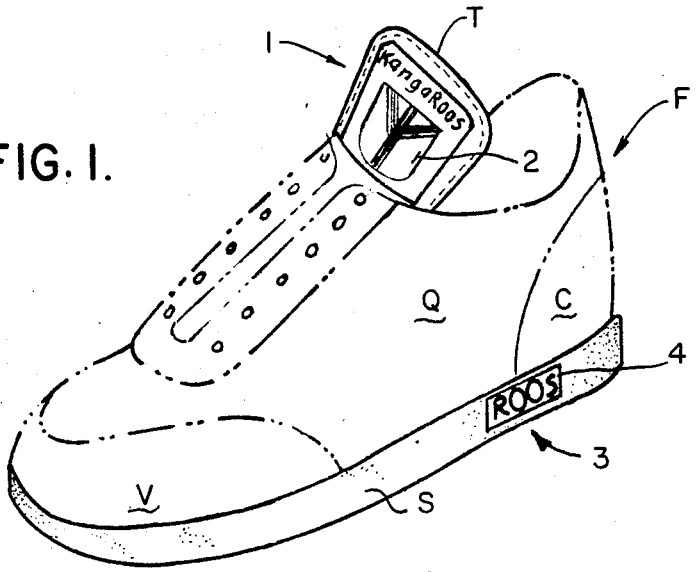

In referring to the drawings, and in particular FIG. 1, there is shown an item of footwear F, which in this particular instance, is disclosed as an athletic shoe, but obviously the subject matter of this invention may be applied to other types of footwear in general, whether it be a casual shoe, or the various types of athletic shoes that are customarily employed in various sporting events, jogging, walking, and the like. More specifically, the athletic shoe as shown includes the usual shoe upper components, including its tongue T, the shoe quarter Q, its vamp and toe cap portion V, and the shoe counter C. In addition, the shoe upper components are rigidly applied to the shoe sole S, which may include the various components that normally make up such an item, such as its tread, midsole, and other various components that are built into the structure of a sole.

As can be seen in FIG. 1, various identifying indicia in the form of designs and trademarks, as shown generally at 1, are furnished upon the surface of the label 2, and are readily exposed for viewing by anyone within proximity of the disclosed footwear. In addition, further identifying indicia, as at 3, may be applied to a support means, as at 4, and appended to the side of the shown sole, in order to provide a ready visual display for ease of viewing by anyone within proximity of the shown footwear.

Figure 2:
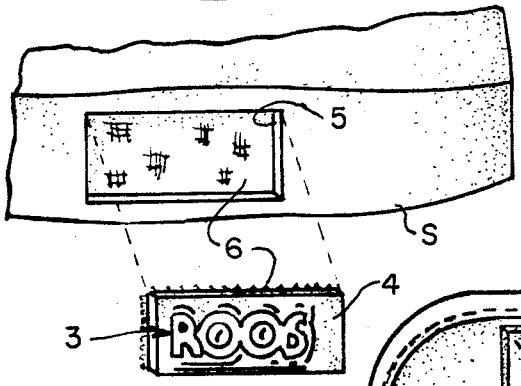
FIG. 2 provides a partial view of the shoe as shown in FIG. 1, showing how the identifying indicia and its support means have been removed form the side of the sole.

As can be seen in FIG. 2, the shoe sole S is disclosed having its usual height, as can be noted, with the support means 4 having its identifying indicia 3 applied thereon, and in this particular instance, displaying a trademark, but obviously any of a variety of designs, displays, trademarks, tradenames, service marks, or the like, or even a color pattern, or differing color shades, can be applied to the supporting surface 4 for ready observance. The support means 4 with its indicia thereon is then applied to the side of the shoe sole, for ready observance. But, in this particular instance, and in order to add a professional touch and appearance to the subject matter of this invention, when embodied in the footwear, the side of the shoe sole is preferably recessed, as at 5, generally to a depth corresponding to the thickness of the supporting means 4, and its adherence means, so that when the support means, which in this particular instance is in the form of a tab, is applied to the side of the sole, its exterior surface will be generally flush with the side of the shoe sole, and give the appearance of having the shown trademark permanently affixed or molded therein. The means for attaching the tab 4 within its recess, in this particular instance, is preferably Velcro, as at 6, comprising the form of hook and pile fastener means that is generally formed of polymer, and for adhering two components together, but in a removable fashion. Thus, when the tab or supporting means 4 of this invention is applied in position, as within the recess 5 formed within the shoe sole, such a tab, with its indicia, may be readily removed, and replaced with another support means containing other forms of design, indicia, colors, or the like.

As is generally known, the customary manner for forming shoe soles during this day and age is to mold it from a foamed polymer, rubber, or the like, and the molding of a recess, such as the recess 5, within the structure of the sole can be easily performed during its initial manufacture. Thus, the manufacturer can then readily apply a tab or plug such as 4 within the recess, while readying the shoes for shipment to the market. Or, in the alternative, it is just as likely that the customer may order various styles of tabs 4, having a variety of information or designs thereon, as previously explained, or even color patterns, and apply them as desired to the shoe so as to add to the fashion and style of the footwear as a complement to other items of clothing that may be worn at the time.

Figure 4:
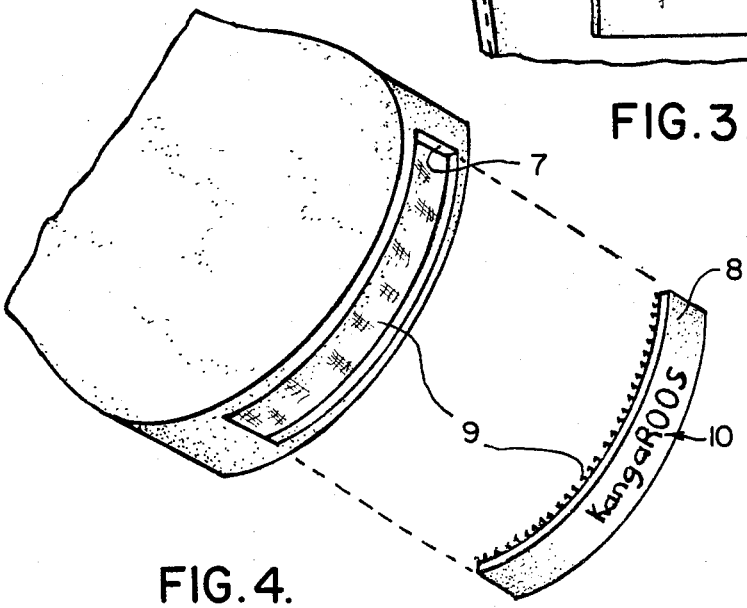
FIG. 4 provides a back view of an athletic shoe, showing how the identifying indicia and its support means may be removed, and replaced, from a length of segment of the shoe side, which in this instance, extends around the shown footwear heel.

As can also be seen in FIG. 4, the concept of this invention is more than just the application of a singular or small tab within the shoe sole, but to the contrary, it can readily be seen that the recess, in this particular instance, as at 7, may extend a substantial distance around the sides of the shoe sole, fully around its back, as around the heel, or even at the front, around the toe portion, so that an insert in the nature of support means 8 having any form of identifying indicia applied thereon, may be readily applied therein, and firmly held by any type of fastening means, such as the Velcro 9 as shown. As can be noted, the support means 8 may include any type of identifying indicia as desired, which in this particular instance shows a particular trademark, as at 10. Obviously, trademarks of this nature may be presented in repeat fashion, upon the support means 8, and extend a substantial distance around the sides of the shoe sole, not only to the extent as shown in FIG. 4, but even all the way around the shoe sole, as desired. And, in this manner, since the support means will be recessed within a slot similar to that as shown at 7, its flush mounting within the shoe sole presents a very pleasing addition to the aesthetics of the footwear, enhancing its style and fashion and adding to the attractiveness of the footwear, if not the overall attire of its wearer. Obviously, the advantages to this particular invention are manifold, the names of various teams may be readily imprinted upon a support means such as that shown at 4, or 8, and even 2, and be applied to the shoes of the athlete before usage. In the alternative, the colors and designs that are applied to the surface of the support means 8, if not the entire construction and molding of support means, may be preselected, and added to the shoe just after manufacture, or perhaps applied to the shoe sole by the athletic team trainer, depending upon the color of the uniform, and whether it will be a home game or a visitor event, to be worn by a team during any particular and select event. Nevertheless, it can readily be understood that the concept of this invention is to provide means for removably mounting of a tab or support means within the structure of an athletic shoe, generally at its sole location, and thereby provide either a means for ease of securement of a trademark or other identifying indicia to the shoe, either as a permanent installation, or one that can be readily removed, and replaced at will, depending upon the selection and desire of the footwear owner and wearer.

Figure 3:
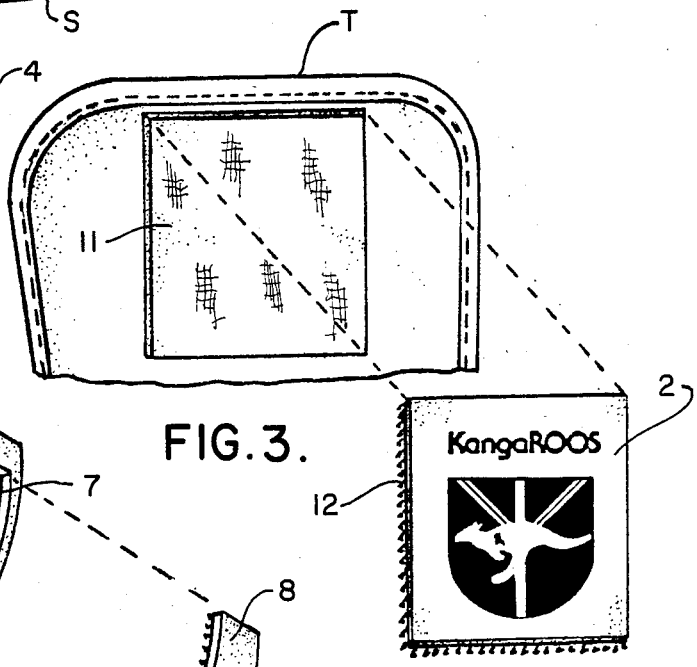
FIG. 3 presents a partial view of the footwear of FIG. 1 showing how the identifying indicia and its support means are removable from the shoe tongue.

As can be noted in FIG. 3, the concept of this invention has further application for the appending of a label, such as the label 2, to other portions of the shoe, which in this particular instance, is shown as being applied to the tongue T. As noted, the tongue will have a segment of fastening means, such as the Velcro 11, applied to it, while the backside of the label 2 functions as a flexible base means and likewise has a corresponding form of fastener means, such as Velcro, sucured to it, as at 12, to provide for the removable attachment of the label, being in this instance the support means for its identifying indicia, for removable securement with the footwear tongue T. While it is not shown herein, it is just as likely that a similar type of attachment may be made for the label, or the like, to other segments of the footwear, such as upon its quarter portion, the counter, the vamp, toe cap, of the like.

Variations or modifications to the structure and application of the subject matter of this invention may occur to those skilled in the art upon reviewing the description of the invention set forth herein. Such variations or modifications, if within the spirit of this invention, are intended to be encompassed within the scope of any claims to patent protection issuing hereon. The description of the preferred embodiment as set forth herein is done so principally for illustrative purposes only.

Having thus described the invention what is claimed and desired to be secured by Letters Patent is:

1. Removable indicia for footwear of the type incorporating a shoe upper securing with a shoe sole, with said shoe sole having an edge having some height and extending a substantial distance around the sides, toe, and heel of the said shoe sole, and disposed for having removably attached thereto the said indicia, comprising, support means removably held to the said sole edge, said support means having an outer surface for displaying indicia, the opposite surface of the support means having a fastener means thereon for adhering to corresponding fastener means permanently applied to the said edge of the shoe sole, and with the said support means and its indicia being removable from the said shoe sole, said fastener means comprising a hook and pile fastening means, said support means comprising a flexible base means having the indicia supported integrally thereon, said support means being removably secured to the shoe sole edge through application of the said fastener means, said sole edge extending approximately around the perimeter of the shoe sole, said sole edge having a recess therein, with said support means and indicia arranged within said sole recess, and wherein said support means and indicia are approximately flush with the sole edge.

2. The invention of claim 1 and wherein said indicia comprising one of a color design, a service mark, a trademark and trade name.

3. The invention of claim 1 and wherein said recess also extending around one of the said side, toe, or heel of the sole edge, and said support means and indicia being arranged generally within said formed recess.

* * * * *

UNITED STATES PATENT AND TRADEMARK OFFICE

CERTIFICATE OF CORRECTION

PATENT NO. : 4,697,362

DATED : October 6, 1987

INVENTOR(S) : Albert Wasserman

It is certified that error appears in the above—identified patent and that said Letters Patent is hereby corrected as shown below:

In the title of the patent, please change "and" to ---an---.

Claim 2, line 2, please insert after "color" and before "design" ---,---.

Signed and Sealed this

Twelfth Day of April, 1988

*Attest:*

DONALD J. QUIGG

*Attesting Officer*

*Commissioner of Patents and Trademarks*